United States Patent [19]

Zvi

[11] Patent Number: 4,829,286

[45] Date of Patent: May 9, 1989

[54] SECURITY FENCE SYSTEM

[75] Inventor: Dank Zvi, Herzlia, Israel

[73] Assignee: Magal Security Systems, Limited, Yehud, Israel

[21] Appl. No.: 46,736

[22] Filed: May 7, 1987

[30] Foreign Application Priority Data

May 20, 1986 [IL] Israel ..... 78856

[51] Int. Cl.[4] ..... G08B 13/00

[52] U.S. Cl. ..... 340/541; 340/555

[58] Field of Search ..... 340/541, 550, 555; 350/96.23; 200/61.93

[56] References Cited

U.S. PATENT DOCUMENTS

| | | | |
|---|---|---|---|
| 3,634,638 | 1/1972 | Savyon et al. | 200/61.93 |
| 3,912,893 | 10/1975 | Stoler | 200/61.93 |
| 4,149,158 | 4/1979 | Iwaoka et al. | 340/568 |
| 4,209,776 | 6/1980 | Frederick | 340/541 |
| 4,234,875 | 11/1980 | Williams | 340/550 |
| 4,275,294 | 6/1981 | Davidson | 250/227 |
| 4,292,628 | 9/1981 | Sadler | 340/531 |
| 4,293,778 | 10/1981 | Williams | 307/147 |
| 4,307,386 | 12/1981 | Bridge | 340/555 |
| 4,367,459 | 1/1983 | Amir et al. | 340/541 |
| 4,367,460 | 1/1983 | Hodara | 340/550 |
| 4,370,020 | 1/1983 | Davey | 350/96.10 |
| 4,371,869 | 2/1983 | Davidson | 340/557 |
| 4,399,430 | 8/1983 | Kitchen | 340/550 |
| 4,436,368 | 3/1984 | Keck | 350/96.33 |
| 4,449,121 | 5/1984 | Sosa | 340/550 |
| 4,450,434 | 5/1984 | Nielsen et al. | 340/506 |
| 4,500,873 | 2/1985 | Porat et al. | 340/515 |
| 4,521,767 | 6/1985 | Bridge | 340/555 |
| 4,527,150 | 7/1985 | Porat | 340/541 |
| 4,538,527 | 9/1985 | Kitchen | 109/21 |
| 4,558,308 | 12/1985 | Ciordinik et al. | 340/550 |
| 4,586,030 | 4/1986 | Klostermann | 340/550 |
| 4,683,356 | 7/1987 | Stoler | 340/541 X |

FOREIGN PATENT DOCUMENTS

| | | | |
|---|---|---|---|
| 0041794 | 12/1981 | European Pat. Off. . | |
| IL66520 | 8/1982 | Israel . | |
| 2038060 | 7/1980 | United Kingdom . | |
| 2039683 | 8/1980 | United Kingdom | 340/550 |
| 2046971 | 11/1980 | United Kingdom . | |
| 2062321 | 5/1981 | United Kingdom . | |
| 1602743 | 11/1981 | United Kingdom . | |
| 1602744 | 11/1981 | United Kingdom . | |
| 2077471 | 12/1981 | United Kingdom . | |
| 2091874 | 8/1982 | United Kingdom | 340/541 |
| 2098770 | 11/1982 | United Kingdom . | |
| 2164183 | 3/1986 | United Kingdom . | |

*Primary Examiner*—Glen R. Swann, III
*Assistant Examiner*—Thomas J. Mullen, Jr.
*Attorney, Agent, or Firm*—Nixon & Vanderhye

[57] ABSTRACT

A taut wire protective fence system, including a plurality of taut wires and a sensor, the sensor including apparatus for bending of an optical fiber in response to displacement of a taut wire, thereby producing sensible attenuation of light passing through the optical fiber.

13 Claims, 6 Drawing Sheets

SECURITY FENCE SYSTEM

FIELD OF THE INVENTION

The present invention relates to taut wire fence systems and to sensors therefor.

BACKGROUND OF THE INVENTION

Various types of taut-wire protective fences are known in the patent literature and in the marketplace. Simply described, taut wire protective fences incorporate tensioned wires which are connected to sensors. These sensors provide an alarm indication of an attempt to climb or cut the fence. U.S. Pat. Nos. 3,634,638 and 3,912,893, owned by applicants, described sensors which are particularly suited for taut wire fence applications and which have found wide market acceptance.

There is described and claimed in applicant's Published UK Patent Application No. (2416) a sensor for taut wire fence systems which has a pair of terminals, each connected to a different taut wire such that predetermined relative motion between the first and second connection terminals produces an electrical connection between first and second electrical contacts, resulting in an alarm indication.

There are also known a variety of security barriers which employ a fiber optics sensing apparatus. U.K. Published Patent Application No. 2,098,770 describes a security barrier structure comprising a lattice of hollow tubular members through which fiber optic cable is threaded. An attempt to break through the barrier breaks or distorts the fiber by overtensioning same, thus causing a sensible attenuation of an optical signal transmitted through the cable.

U.K. Published Patent Application Nos. 2,038,060; 2,046,971 and 2,062,321 and U.S. Pat. Nos. 4,292,628 and 4,399,430 all show security applications, wherein an alarm indication is provided by breakage of an optical fiber. U.K. Published Patent Application No. 2,077,471 shows a security application wherein a pressure sensitive fiber optic composite cable is provided. Israel Pat. No. 66520 describes an intrusion warning wire fence comprising an outer core and an inner coaxial optical fiber.

SUMMARY OF THE INVENTION

The present invention seeks to provide a taut wire system of a different type from those described hereinabove.

There is thus provided in accordance with a preferred embodiment of the present invention a taut wire protective fence system, including a plurality of taut wires and a sensor, the sensor comprising apparatus for bending of an optical fiber in response to displacement of a taut wire, thereby producing sensible attenuation of light passing through the optical fiber.

According to a preferred embodiment of the invention, the sensor is operative to provide greater attenuation in an optical fiber in response to displacement of a taut wire than would be produced by a corresponding displacement of the optical fiber itself. Thus, the sensor of the present invention may be understood as providing apparatus for amplifying or enhancing the alarm indication signal produced by displacement of the taut wire. This is achieved according to a preferred embodiment of the invention by producing sharp localized bending of the optical fiber, here termed "microbending" in response to even relatively small displacements of the taut wires.

In accordance with one embodiment of the invention, the sensor comprises a base, a taut wire connection element movably mounted with respect to the base and being arranged for engagement with at least one taut wire, whereby displacement of the at least one taut wire produces movement of the connection element relative to the base and optical fiber engagement apparatus associated with the connection element whereby at least predetermined movement of the connection element produces engagement with an optical fiber, causing a sensible change in transmission of optical signals therethrough.

In accordance with a preferred embodiment of the present invention, the at least one taut wire comprises a pair of taut wires and relative displacement of the pair of taut wires produces rotation of the connection element.

Additionally in accordance with a preferred embodiment of the present invention, the optical fiber engagement apparatus is rotatably mounted with respect to the base and loosely coupled to the connection element. More specifically, the engagement apparatus may be coupled for coaxial rotation with the connection element via a viscous material, whereby only relatively short time constant displacements cause rotation of the engagement apparatus and engagement with the optical fiber.

In accordance with this embodiment of the invention, the connection element has associated therewith propeller means engaging the viscous material.

Additionally in accordance with an embodiment of the invention, there are provided means for limiting the rotation of the connection element to predetermined limits, in order to prevent damage to the optical fiber.

Further in accordance with an embodiment of the invention, there is provided apparatus for sensing changes in the transmission characteristics of the optical fiber and for providing an alarm indication in response thereto.

In accordance with an alternative embodiment of the present invention, the connection element and the optical fiber engagement apparatus are unitary or fixed together. In one embodiment, an apertured plate is rotatably mounted onto the base, the plate defining the engagement apparatus and an optical fiber being drawn through the aperture. A taut wire is coupled to an extension of the plate, defining the connection element.

According to a further alternative embodiment of the present invention, the connection element and the optical fiber engagement apparatus comprise a generally cylindrical cap member onto the outside of which is attached a taut wire, the inside surface of which defines an undulating surface which presses onto optical fibers wound about a flexible core, producing changes in the transmission characteristics of the optical fibers.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
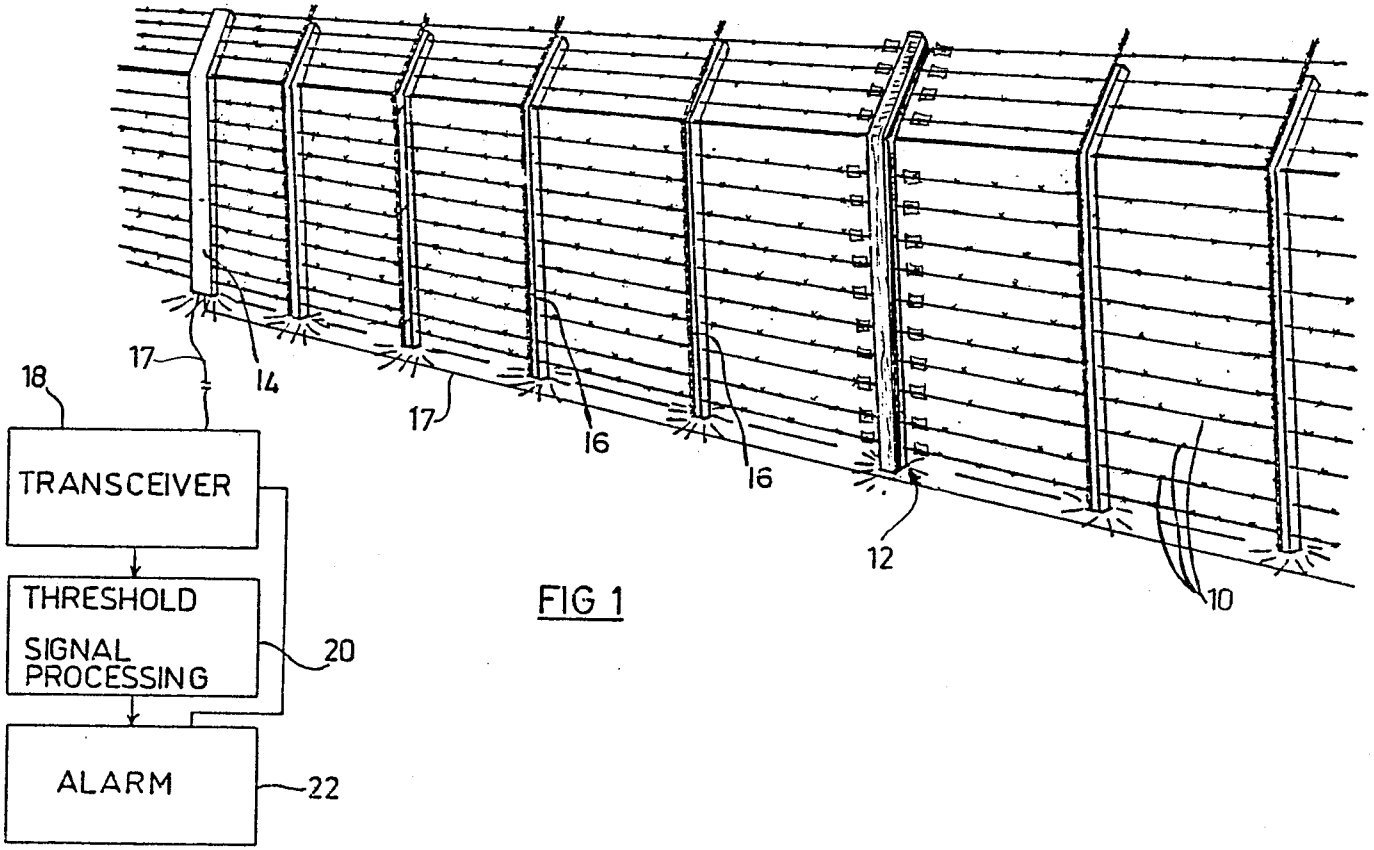
FIG. 1 is a pictorial illustration of a portion of a taut wire fence system constructed and operative in accordance with a preferred embodiment of the present invention.

Reference is now made to FIG. 1, where there is shown a portion of a taut-wire intrusion detection fence system comprising taut wires 10 strung in generally parallel orientation and mounted between an anchoring post 12 and a sensor post 14. Intermediate the anchoring post 12 and the sensor post 14 are a plurality of intermediate posts 16 which are outside the scope of the present invention.

According to a preferred embodiment of the present invention, the sensor post 14 is formed as a unitary elongate element having a uniform cross section. Preferably sensor post 14 comprises an extruded member having mounted therealong a plurality of sensors, such as those illustrated in FIGS. 2–6B.

An optical fiber 17 is theaded serially through a plurality of adjacent sensor posts and may be directly coupled to a signal transceiver 18, such as a TEK fiber optic TDR cable tester, manufactured by Tektronix, of Portland, Oreg., U.S.A., hereinafter referred to as "OTDR". The OTDR apparatus provides a suitable optical signal for passage through optical fiber 17 and receives the reflected signal therefrom.

Alternatively, in place of the OTDR, a spectrum analyzer having a built in transceiver, such as a TEK portable spectrum analyzer 490 series, also available from Tektronix, may be employed. Apparatus of this type may be used to provide output indications of the existence and approximate location of bending of or other engagement with the optical fiber and resultant attenuation, phase change and signal reflections, or any one or more of the foregoing.

The output of the transceiver 18 may be provided to threshold and signal processing circuitry 20 for automatic determination of whether an alarm indication exists based on predetermined thresholds or other criteria. Alternatively, an operator may monitor the transceiver 18 in order to perceive an alarm indication. The output of transceiver of processing circuitry 20 may be supplied to alarm indication circuitry 22 which provides a suitable alarm output indication of the existence and approximate location of the attempted intrusion.

The signal processing circuitry 20 may include means for classifying alarm indications based on the time rate of change of analog bending or other engagment parameters sensed by the OTDR or spectrum analyzer.

Figure 2:
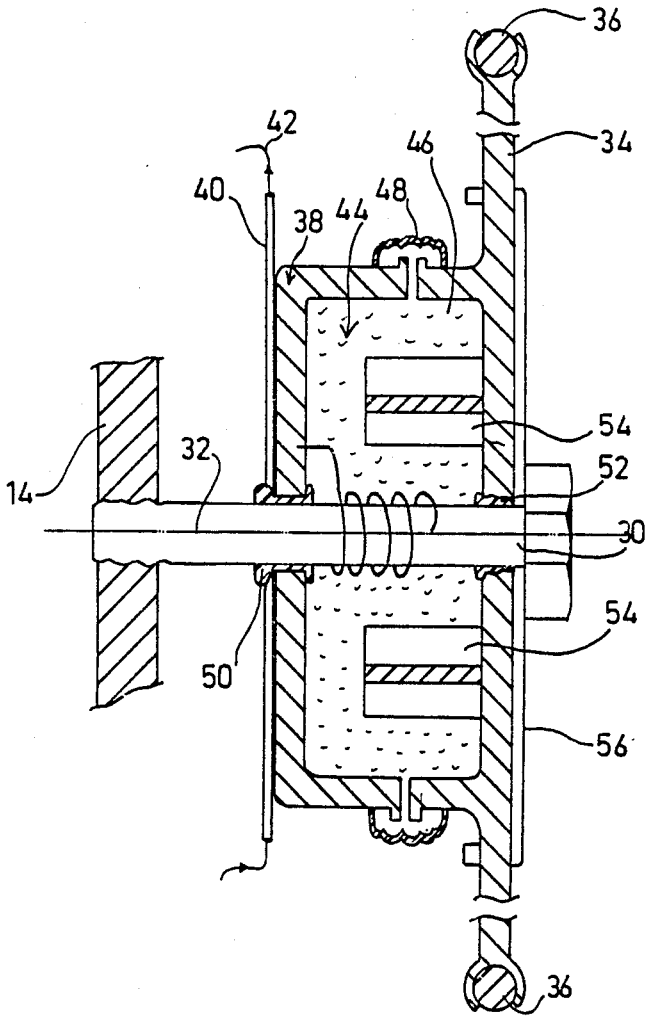
FIG. 2 is a side view, sectional illustration of a sensor constructed and operative in accordance with a preferred embodiment of the present invention.
Figure 3B:
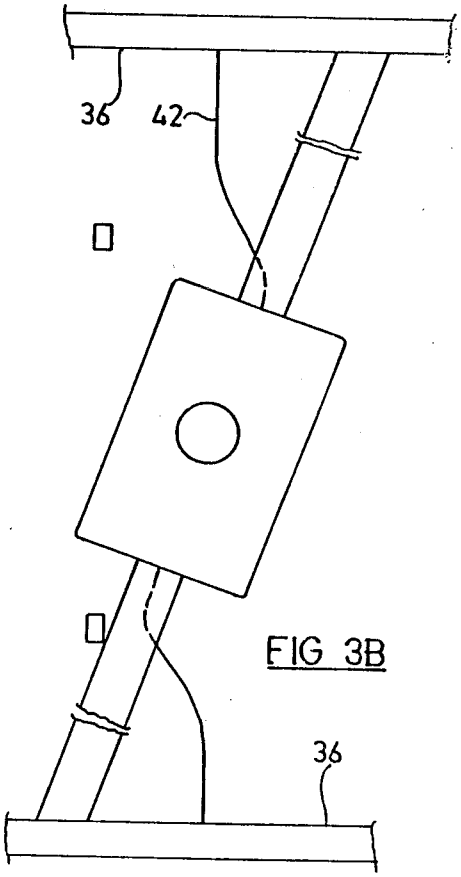
FIGS. 3A and 3B are pictorial illustrations of the sensor of FIG. 2 in respective at rest and alarm orientations.
Figure 3A:
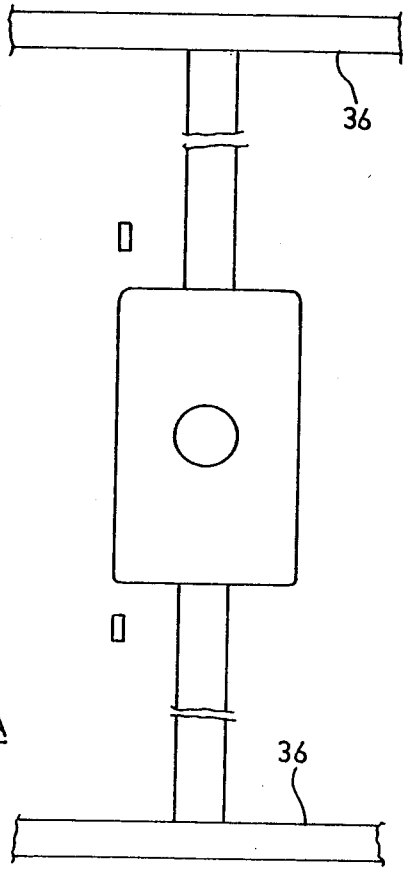

Reference is now made to FIGS. 2, 3A and 3B, which illustrate a sensor constructed and operative in accordance with a preferred embodiment of the present invention. The sensor comprises a mounting pin 30, which is fixedly mounted onto sensor post 14 and which defines a rotation axis 32.

Rotatably mounted onto pin 30 for rotation about axis 32 is a taut wire connection element 34, typically in the form of a rod, which may be of selectable length, which engages a pair of taut wires 36 and is caused to undergo rotational displacement in response to relative linear displacement of the taut wires 36.

An optical fiber engagement member 38 is also rotatably mounted onto rod 30 for rotation about axis 32. Engagement member 38 defines a hollow tube 40 through which an optical fiber 42 is threaded. Alternatively any other suitable means for mounting the optical fiber 42 onto engagement member 38 may be employed.

Connection element 34 and engagement member 38 are together configured to define a cup configuration, indicated generally by reference numeral 44, wherein there is disposed a viscous material 46, such as silicone putty, for example General Electric G-E SS-91 silicone bouncing putty.

Escape of the viscous material 46 from the cup 44 is prevented by a flexible peripheral seal 48 joining connection element 34 and engagement member 38 and flexible rotational seals 50 and 52 which seal the junctions between pin 30 and the respective engagement member 38 and connection element 34.

Fixedly attached to connection element 34 are vanes 54 which are disposed in cup 44 in engagement with viscous material 46 and which are operative in response to rotation of element 34, to drive the viscous material 46 in corresponding rotation. The frictional engagement between viscous material 46 and engagement member 38 causes member 38 to undergo corresponding rotation, in response to short time scale rotational displacements of element 34.

Changes in the rotational orientation of element 34 which occur over long time constants, typically hours, and which are not characteristic of attempted intrusions, as opposed to changes occuring in seconds or minutes, which are characteristic of intrusions, do not produce corresponding rotation of member 38, due to the characteristics of the viscous material, which does not transmit rotational forces occuring over long time constants.

Rotation of engagement member 34 causes a corresponding rotation of tube 40 and results in bending or other engagement with optical fiber 42, which causes changes in the light transmission characteristics of optical fiber 42. As mentioned above, these changes in characteristics are readily sensed by the OTDR apparatus (FIG. 1).

In order to prevent permanent damage to the optical fiber 42 due to overtensioning thereof, a limiting element 56 is provided to limit the angular rotation of element 34 to a safe range, typically +/−30 degrees, at which no damage to the optical fiber 42 will occur.

FIGS. 3A and 3B illustrate the sensor of FIG. 2 in respective at rest and extreme rotation (alarm) orientations.

Figure 4A:
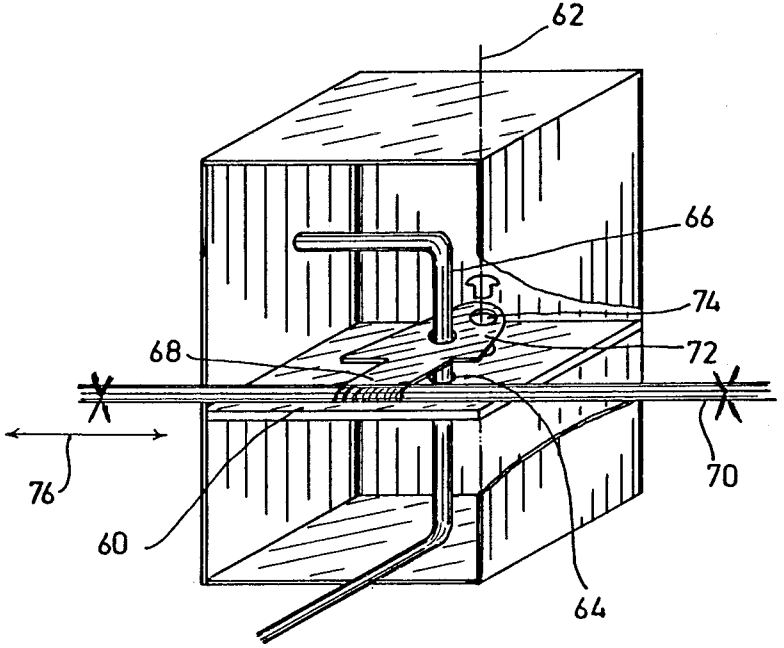
FIGS. 4A and 4B are pictorial illustrations of a sensor according to an alternative embodiment of the invention.
Figure 4B:
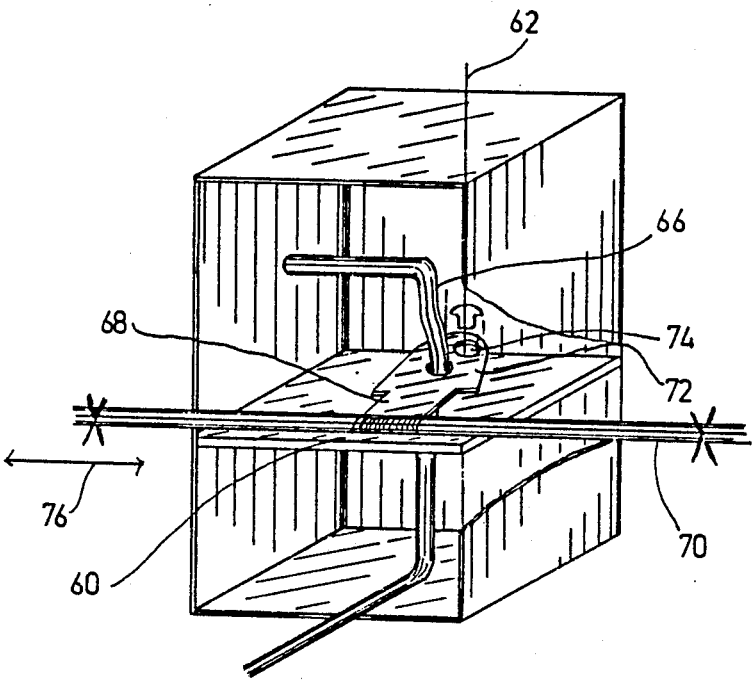
Figure 6A:
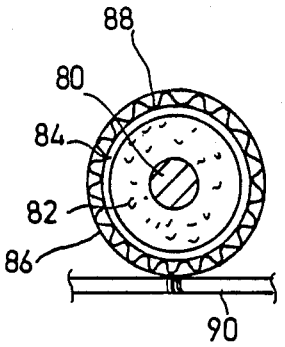
FIGS. 6A and 6B are sectional illustrations of the sensor of FIGS. 5A and 5B taken along the lines VI—VI in FIG. 5B, in respective at rest and alarm orientations.
Figure 6B:
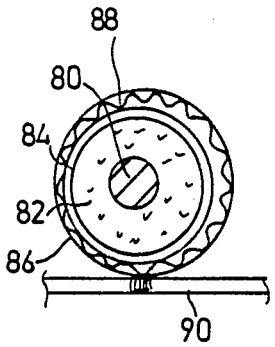
Figure 5B:
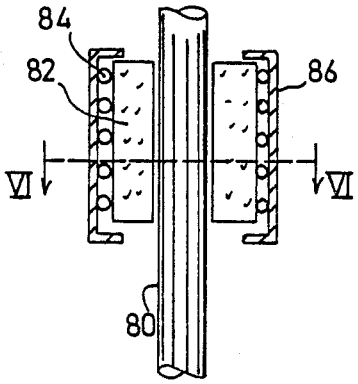
FIGS. 5A and 5B are respective pictorial and sectional illustrations of a further alternative embodiment of sensor constructed and operative in accordance with an embodiment of the present invention.
Figure 5A:
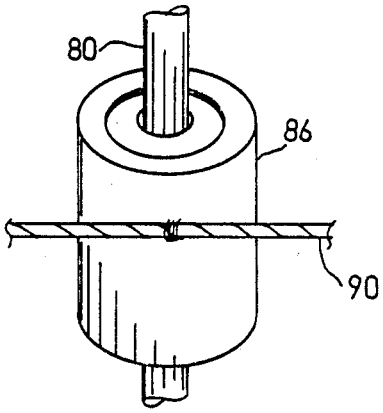

Reference is now made to FIGS. 4A and 4B which illustrate an alternative embodiment of a sensor constructed and operative in accordance with a preferred embodiment of the present invention. The sensor comprises a base plate 60 defining a pivot axis 62 and having an aperture 64 through which extends an optical fiber 66. A taut wire connection element 68 is connected to a taut wire 70 and is fixedly attached to or unitarily formed with an optical fiber engagement member 72.

Engagement member 72 is typically formed as a plate, which is spaced from and pivotably mounted onto base plate 60 for rotation about pivot axis 62. Engagement member 72 is formed with an aperture 74 which, when member 72 is an a rest position, as seen in FIG. 4A, is typically in registration with aperture 64, such that the optical fiber 66 extends straight through both apertures.

When optical fiber engagement member 72 is displaced from its rest position as seen in FIG. 4B, for example, due to the displacement of the taut wire along its axis 76, and consequent displacement of connection element 68 occurs, aperture 74 is no longer in registration with aperture 64, causing bending or other engagement with the optical fiber 66, such that its transmission characteristics are temporarily changed, in a manner which is sensible to the OTDR or other suitable apparatus (FIG. 1).

Reference is now made to FIGS. 5A, 5B, 6A and 6B, which illustrate yet another embodiment of a sensor constructed and operative in accordance with a preferred embodiment of the present invention. The sensor comprises a support shaft 80 surrounded by an annular shaped flexible package of flexible viscous material 82, such as silicone putty. An optical fiber 84 is coiled about the flexible material.

Surrounding the material 82 and the coiled fiber 84 is a combination optical fiber engagement member and taut wire connection element 86 which is of a generally cylindrical outer configuration and which is formed with radially inward extending teeth 88, which extend axially parallel to shaft 80. A taut wire 90 is coupled to the outside of combintaion element 86.

The sensor of FIGS. 5A, 5B, 6A and 6B is operative to provide a sensible bending or other engagement between the teeth 88 and the optical fiber 84 in response to short time scale displacements of taut wire 90. Long time scale changes in the orientation or displacement of taut wire 90 do not produce a sensible bending or other engagement due to the characteristics of the material 82, thus preventing false alarms due to temperature changes or other natural changes in the ambient environment which are not characteristic of an attempted intrusion.

It will be appreciated by persons skilled in the art that the present invention is not limited by what has been particularly shown and described hereinabove. Rather the scope of the present invention is defined only by the claims which follow:

I claim:

1. A taut wire protective fence system comprising:

a plurality of taut wires and a sensor, the sensor comprising means for producing bending of an optical fiber in response to displacement of a taut wire, thereby producing sensible attenuation of light passing through the optical fiber, said sensor comprising a base;

a taut wire connection element movably mounted with respect to the base and being arranged for association with at least one taut wire, whereby displacement of the at least one taut wire produces displacement of the connection element relative to the base; and optical fiber engagement means associated with the connection element whereby at least predetermined displacement of the connection element produces bending of an optical fiber, causing a sensible change in transmission of optical signals therethrough, and wherein said at least one taut wire comprises a pair of taut wires and relative displacement of the pair of taut wires produces movement of the connection element.

2. Apparatus according to claim 1 and wherein said the sensor is operative to provide greater attenuation in an optical fiber in response to a given displacement of a taut wire than would be produced by a corresponding displacement of the optical fiber itself.

3. Apparatus according to claim 2 wherein said sensor comprises means for enhancing the bending of the optical fiber produced by displacement of the taut wire.

4. Apparatus according to claim 3 and wherein said means for enhancing comprises means for producing sharp localized bending of the optical fiber, in response to even relatively small displacements of a taut wire.

5. Apparatus according to claim 1 and also comprising means for sensing changes in the transmission characteristics of the optical fiber and for providing an alarm indication in response thereto.

6. A taut wire fence system according to claim 5 and also comprisng an arrangement of taut wires defining a physical barrier.

7. A taut wire protective fence system comprising:

a plurality of taut wires and a sensor, the sensor comprising means for producing bending of an optical fiber in response to displacement of a taut wire, thereby producing sensible attenuation of light passing through the optical fiber, said sensor comprising a base;

a taut wire connection element movably mounted with respect to the base and being arranged for association with at least one taut wire, whereby displacement of the at least one taut wire produces displacement of the connection element relative to the base; and optical fiber engagement means associated with the connection element whereby at least predetermined displacement of the connection element produces bending of an optical fiber, causing a sensible change in transmission of optical signals therethrough, and wherein said optical fiber engagement means is rotatably mounted with respect to the base and loosely coupled to the connection element.

8. Apparatus according to claim 7 and wherein said engagement means is coupled for coaxial rotation with the connection element via a viscous material, whereby only relatively short time constant displacements of the taut wire cause rotation of the engagement apparatus and engagement with the optical fiber.

9. Apparatus according to claim 8 and wherein said connection element has associated therewith propeller means engaging the viscous material.

10. Apparatus according to claim 7 and wherein said connection element and said optical fiber engagement means are unitary or fixed together.

11. Apparatus according to claim 10 and wherein connection element and said engagement means comprise an apertured plate which is movably mounted onto the base, the optical fiber being drawn through the aperture and a taut wire being coupled to an extension of the plate, defining the connection element.

12. Apparatus according to claim 10 and wherein said connection element and said optical fiber engagment means comprise a generally cylindrical cap member onto the outside of which is attached a taut wire, the inside surface of which defines a ribbed surface which presses onto optical fibers wound about a flexible core, in response to short time constant displacements of the taut wire, producing changes in the transmission characteristics of the optical fibers.

13. A taut wire protective fence system comprising:

a plurality of taut wires and a sensor, the sensor comprising means for producing bending of an optical fiber in response to displacement of a taut wire, thereby producing sensible attenuation of light passing through the optical fiber, said sensor comprising a base;

a taut wire connection element movably mounted with respect to the base and being arranged for association with at least one taut wire, whereby displacement of the at least one taut wire produces displacement of the connection element relative to the base; and optical fiber engagement means associated with the connection element whereby at least predetermined displacement of the connection element produces bending of an optical fiber, causing a sensible change in transmission of optical signals therethrough, said system also comprising means for limiting the movement of the connection element to predetermined limits, in order to prevent damage to the optical fiber.

* * * * *